US005595145A

United States Patent [19]

Ozawa

[11] Patent Number: 5,595,145

[45] Date of Patent: Jan. 21, 1997

[54] COOLING STRUCTURE OF DIESEL ENGINE PISTON

[75] Inventor: Godo Ozawa, Utsunomiya, Japan

[73] Assignee: Kabushiki Kaisha Komatsu Seisakusho, Tokyo, Japan

[21] Appl. No.: 454,915

[22] Filed: May 31, 1995

[51] Int. Cl.[6] ..... F01P 1/04

[52] U.S. Cl. ..... 123/41.35; 92/186

[58] Field of Search ..... 123/41.35, 193.6; 92/186

[56] References Cited

U.S. PATENT DOCUMENTS

| | | | |
|---|---|---|---|
| 4,517,930 | 5/1985 | Nakano et al. | 123/41.35 |
| 4,715,335 | 12/1987 | Elsbett et al. | 123/41.35 |
| 4,867,119 | 9/1989 | Cooper et al. | 123/41.35 |
| 5,065,706 | 11/1991 | Zvonkovic | 123/41.35 |

FOREIGN PATENT DOCUMENTS

| | | | |
|---|---|---|---|
| 3518497 | 11/1986 | Germany | 123/41.35 |
| 57-171149 | 10/1982 | Japan . | |
| 64-41648 | 3/1989 | Japan . | |
| 3-52357 | 5/1991 | Japan . | |
| 7-10449 | 2/1995 | Japan . | |
| 2205922 | 12/1988 | United Kingdom | 123/41.35 |

*Primary Examiner*—David A. Okonsky
*Attorney, Agent, or Firm*—Sidley & Austin

[57] ABSTRACT

A diesel engine piston, which exhibits high resistance to heat load, has a cooling cavity formed circumferentially around and outwardly of the outer periphery of a reentrant combustion chamber. A cooling liquid inlet passageway through which cooling liquid is supplied is provided in the piston body. The inside diameter of the cooling cavity is smaller adjacent to the top of the piston than adjacent to the bottom of the piston, and the cross-sectional area of the cooling cavity gradually increases from the bottom of the cooling cavity toward the top of the cooling cavity. A funnel wall, which projects downwardly toward the bottom of the piston, serves as the inlet of the cooling liquid inlet passageway. A distributing member, positioned within the cooling cavity directly above the outlet of the cooling liquid inlet passageway, splits the cooling liquid into two streams for passage in opposite directions through two segments of the cooling cavity.

20 Claims, 4 Drawing Sheets

COOLING STRUCTURE OF DIESEL ENGINE PISTON

FIELD OF THE INVENTION

The present invention relates to a diesel engine piston, particularly to a cooling structure of a diesel engine piston, and, more particularly, to a cooling structure of a diesel engine piston having a reentrant type combustion chamber which requires an especially high resistance to heat load.

BACKGROUND OF THE INVENTION

FIG. 7 shows a known conventional diesel engine piston having a reentrant type combustion chamber, which is required to exhibit resistance to heat load, and a cooling structure for the reentrant type combustion chamber of the piston. Specifically, an annular cooling cavity 52 is formed in the body of the piston 50 around and outwardly of the outer periphery of a reentrant type combustion chamber 51, which is formed in the piston top face 55 and is eccentrically positioned with respect to the central longitudinal axis of the piston 50. A lower transverse wall 56 projects inwardly from the piston skirt toward the central longitudinal axis of the piston 50 and forms the bottom of the reentrant type combustion chamber 51. The top face 55 of the piston 50 projects radially inwardly beyond the maximum diameter of the reentrant type combustion chamber 51 so that the reentrant section 54, which is the junction of the top face 55 and the reentrant type combustion chamber 51, is an inwardly directed annular lip overhanging the outer portion of the reentrant type combustion chamber 51. During operation, a cooling liquid is supplied to the cooling cavity 52 through a cooling liquid inlet (not shown) so as to cool the piston top face 55, including especially the annular reentrant section 54 which becomes very hot. The cross-sectional area of the cooling cavity 52 in a plane containing the longitudinal axis of the piston 50 is larger near the bottom of the cooling cavity 52 than toward the top of the cooling cavity 52.

The conventional cooling structure of the diesel engine piston 50, however, presents the following problem. With an increasing output of the engine, the piston 50 tends to be subjected to a higher heat load. This causes the annular reentrant section 54 to become hotter and to incur deformation, cracking, melting, or the like. The result is a deteriorated durability of the reentrant type combustion chamber 51.

SUMMARY OF THE INVENTION

The present invention is directed to solving the problem with the prior art piston described above, and an object of the present invention is to provide a diesel engine piston with an improved cooling structure so that the piston has a high resistance to a heat load.

In the cooling structure of a diesel engine piston according to the present invention, an annular cooling cavity is formed circumferentially around and outwardly of the outer periphery of a reentrant type combustion chamber, the diameter of the inner wall surface of the cooling cavity is smaller adjacent the top face of the piston than adjacent the lower transverse wall of the piston, and the cooling cavity is provided with a cooling liquid inlet passageway through which a cooling liquid is supplied. In addition, the cross-sectional area of the cooling cavity is gradually increased from the bottom of the cooling cavity toward the top of the cooling cavity.

The inner periphery of the cooling liquid inlet passageway can be a generally frustoconical surface which expands outwardly and downwardly from the bottom of the cooling cavity through the lower transverse wall of the piston toward the bottom of the piston, preferably forming an outwardly and downwardly diverging annular funnel wall extending downwardly below the lower transverse wall of the piston. The outlet of the cooling liquid inlet passageway is provided in the vicinity of the portion of the annular cooling cavity where the radial distance between the reentrant combustion chamber and the outer periphery of the piston is at a minimum.

The cooling cavity can be provided with a distributing member which is located above the outlet of the cooling liquid inlet passageway and which juts downwardly from the top of the cooling cavity toward the outlet of the cooling liquid inlet passageway.

The operation of the structure in accordance with the present invention will be described.

One of the characteristics of the present invention is the shape of the cooling cavity. More specifically, the cross-sectional shape of the piston in a plane containing the central longitudinal axis of the piston shows that the top portion of the cooling cavity projects radially inwardly toward the central longitudinal axis of the piston further than the bottom portion of the cooling cavity does. Thus, the diameter of the inner wall surface of the cooling cavity is smaller adjacent to the top face of the piston than adjacent to the lower transverse wall of the piston. This means that the cooling liquid flowing in the top portion of the cooling cavity of the piston of the present invention is closer to the reentrant section than is the case with the prior art cooling structure described hereinabove. Thus, the amount of heat radiation, which is inversely proportional to distance, increases and the cooling effect of the cooling liquid improves, thereby making it possible to prevent the reentrant section from becoming excessively hot.

Moreover, since the cross-sectional area of the cooling cavity gradually increases from the bottom of the cooling cavity toward the top of the cooling cavity, which is adjacent the top face of the piston, further improved cooling performance can be achieved.

The funnel wall provided as the inlet of the cooling liquid inlet passageway permits the cooling liquid to be efficiently supplied by a cooling nozzle, located below the piston, through the cooling liquid inlet passageway into the cooling cavity.

Further, the provision of the cooling liquid inlet passageway in the vicinity of the portion of the annular cooling cavity, where the radial distance between the reentrant type combustion chamber and the outer periphery of the piston is at its shortest, allows the low temperature cooling liquid initially entering the cooling cavity to promptly flow in the vicinity of the portion of the reentrant section which would become the hottest, thereby permitting efficient cooling.

When the distributing member is provided in the cooling cavity into which the cooling liquid is supplied, the cooling liquid can be divided in two streams of predetermined proportions which are allowed to flow into clockwise and counterclockwise directions in the annular cooling cavity. This leads to better cooling performance.

DESCRIPTION OF THE PREFERRED EMBODIMENTS

An embodiment of the cooling structure of a diesel engine piston in accordance with the present invention will be described with reference to FIGS. 1–6.

Figure 6:
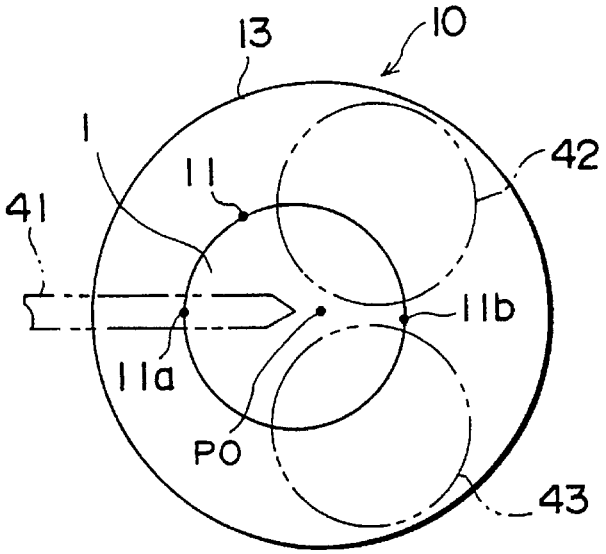
FIG. 6 is a schematic diagram of the structure in the top of a two-valve piston chamber of a direct injection diesel engine according to the present invention.

FIG. 6 is a schematic diagram showing the structure of the top section of a two-valve piston chamber of a direct injection diesel engine to which the present invention is applied. A piston 10 is provided with a reentrant type combustion chamber 1 formed in the top face 3 of the piston 10, with the reentrant type combustion chamber 1 being decentered with respect to the central longitudinal axis Pa of the piston 10. A fuel injection nozzle 41, which extends from the left downwardly to the right in FIG. 6, is positioned above the portion of the piston top face 3 where the radial distance between the annular reentrant section 11 and the generally cylindrical outer periphery 13 of the piston 10 decreases to a minimum due to the combustion chamber 1 being decentered. An intake valve 42 is provided in the top right portion of the cylinder head, while an exhaust valve 43 is provided in the bottom right portion of the cylinder head, as viewed in FIG. 6. This arrangement, with the reentrant type combustion chamber 1 installed off-center, permits high fuel efficiency.

More details of the structure of the piston 10 will be described with reference to FIGS. 1–5. The piston 10, which can be made of nodular graphite cast iron, is provided with the reentrant type combustion chamber 1 in the vicinity of the center of the piston top face 3 but decentered with respect to the longitudinal axis of the piston 10. The combustion chamber 1 is in the form of an upwardly opening cavity in the top face 3 of the piston 10. The annular reentrant section 11, which is the junction of the top face 3 and the top end of the combustion chamber 1, projects radially inwardly toward the longitudinal axis of the piston 10 in the form of an annular lip overhanging the outer portion of the reentrant type combustion chamber 1. The central portion of the bottom of the combustion chamber 1 is in the form of a central dome 12 which projects upwardly above the outer annular portion of the bottom of the combustion chamber 1.

A continuous annular cooling cavity 2 (including segmental portions 2*a*, 2*b*, 2*c*), which constitutes the passageway for the cooling liquid through the body of the piston 10, is formed in the body of the piston 10 between the combustion chamber 1 and the radially adjacent portion of the outer periphery 13 of the piston 10 so that the cooling cavity 2 extends circumferentially around and outwardly of the outer periphery of the combustion chamber 1. The cooling cavity 2 is provided with a cooling liquid inlet passageway 23 and two cooling liquid outlets 24*a*, 24*b*.

Figure 1:
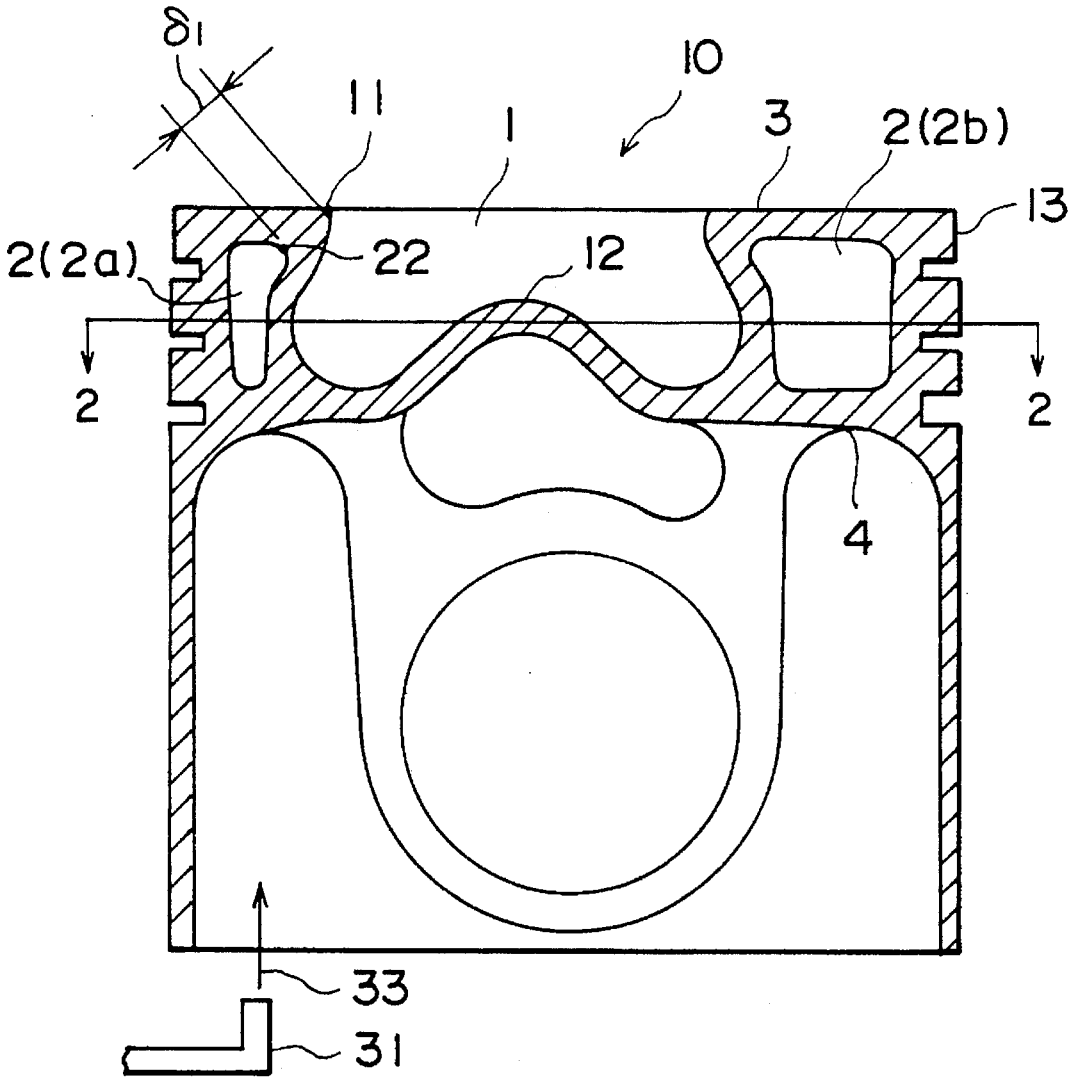
FIG. 1 is a longitudinal cross-sectional view which includes the central longitudinal axis of a piston according to an embodiment of the present invention.
Figure 2:
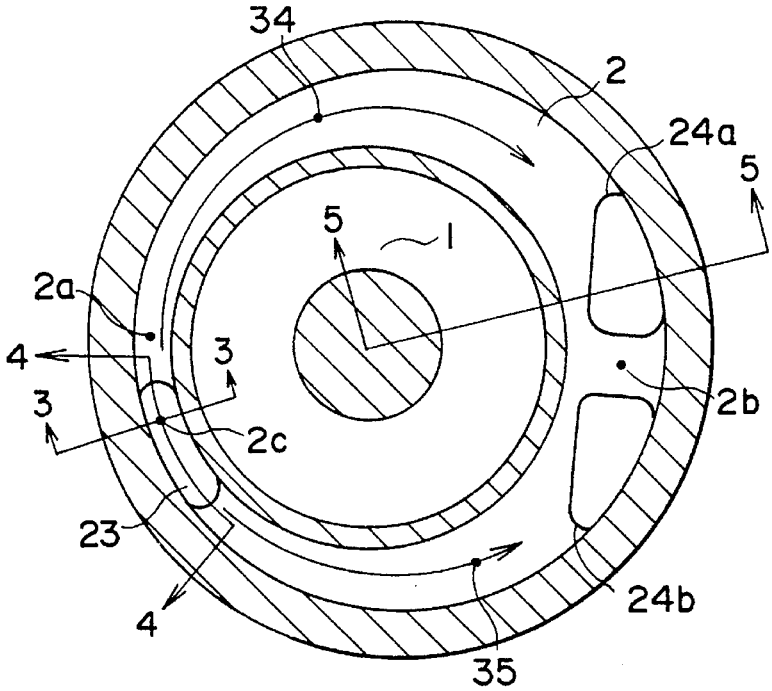
FIG. 2 is a cross-sectional view taken along line 2—2 in FIG. 1.

As shown in FIG. 2, the annular or radial width of the cooling cavity 2, along a radial line in a plane perpendicular to the longitudinal axis of the piston 10, i.e., the difference between the diameter of the inner annular wall surface of the cooling cavity 2 and the diameter of the outer annular wall surface of the cooling cavity 2, measured along a common line radial to the longitudinal axis of the piston 10, continuously varies about the circumference of the cooling cavity 2 in a plane perpendicular to the longitudinal axis of the piston 10, with the radial width in a given plane perpendicular to the longitudinal axis of the piston 10 being the smallest at the portion 2*a* of the cooling cavity 2 and the largest at the portion 2*b* of the cooling cavity 2. As shown by FIG. 1, the radial width of the cooling cavity 2, viewed in a plane containing the longitudinal axis of the piston 10, also varies from a minimum radial width at the bottom portion of the cooling cavity 2, adjacent to the lower transverse wall 4, to a maximum radial width at the top portion of the cooling cavity 2, adjacent to the top face 3. In the illustrated embodiment, the radial width of the cooling cavity 2, viewed in a plane containing the longitudinal axis of the piston 10, gradually increases from the minimum radial width at the bottom portion of the cooling cavity 2 to the maximum radial width at the top portion of the cooling cavity 2. Moreover, the top portion of the cooling cavity 2 projects radially inwardly toward the longitudinal axis of the piston 10 further than the bottom portion of the cooling cavity 2, while the outer annular wall surface of the cooling cavity 2 is generally parallel to the cylindrical periphery 13. This means that the diameter of the inner annular wall surface of the cooling cavity 2, in a plane perpendicular to the longitudinal axis of the piston 10, is smaller adjacent to the piston top face 3 than adjacent to the lower transverse wall 4 of the piston 10, when viewed at a common location on the circumference of the inner annular wall surface of the cooling cavity 2, and that the cross-sectional area of the top portion of the cooling cavity 2 is larger than that of the bottom portion of the cooling cavity 2. The top portion of the cooling cavity 2, which is near the piston top face 3, projects radially inwardly toward the longitudinal axis of the piston 10 to decrease the thickness of the wall between the inner annular wall surface of the cooling cavity 2 and the radially adjacent annular wall surface of the combustion chamber 1, thereby improving the cooling effect for the wall surface of the combustion chamber 1, especially the reentrant section 11 which becomes very hot.

Figure 3:
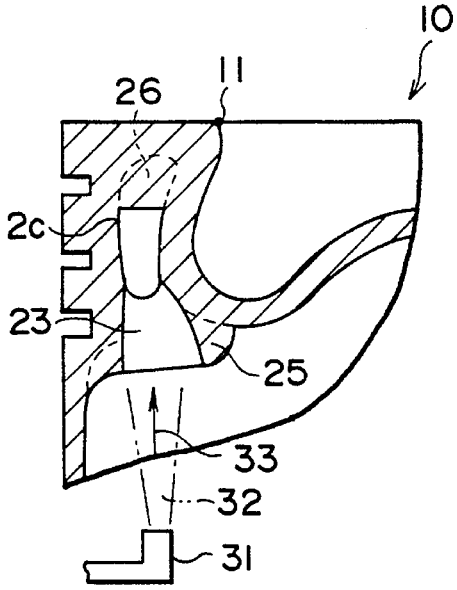
FIG. 3 is a cross-sectional view taken along line 3—3 in FIG. 2.

As shown in FIG. 2, the outlet of the cooling liquid inlet passageway 23 is an ovally shaped opening in the bottom of the portion 2*c* of the annular cooling cavity 2, the portion 2*c* being located in close proximity to the cooling cavity portion 2*a* which has the smallest annular width in a radial direction. As shown in FIG. 3, the interior annular surface of the cooling liquid inlet passageway 23 has a generally frustoconical configuration which diverges downwardly and outwardly so that the width of the cooling liquid inlet passageway in the radial direction increases toward the bottom of the piston 10. In a presently preferred embodiment, an annular funnel wall 25 extends downwardly from the lower transverse wall 4 to form the lower or inlet portion of the cooling liquid inlet passageway 23.

Figure 4:
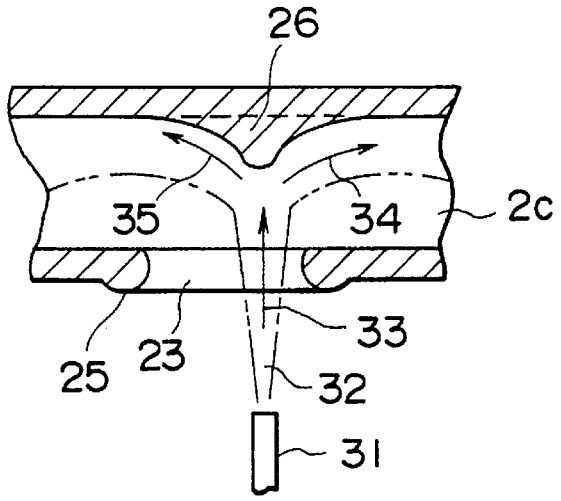
FIG. 4 is a cross-sectional view taken along line 4—4 in FIG. 2.

A distributing member 26 is formed in the top wall surface of the cooling cavity portion 2*c* located right above the outlet opening of the cooling liquid inlet passageway 23. The distributing member 26 has an approximately triangular cross-section in a plane tangential to the annular centerline of the cooling cavity 2 at the midpoint of the distributing member 26, with the apex pointing downwardly toward the outlet opening of the cooling liquid inlet passageway 23, and with the height of the distributing member 26 being less than the height of the cooling cavity 2, as illustrated in FIGS. 3 and 4. As shown in FIG. 4, the apex of the distributing wall can be displaced from the center of the outlet of the cooling liquid inlet passageway 23 to aid in providing the desired proportions of the two resulting streams of cooling liquid.

Figure 5:
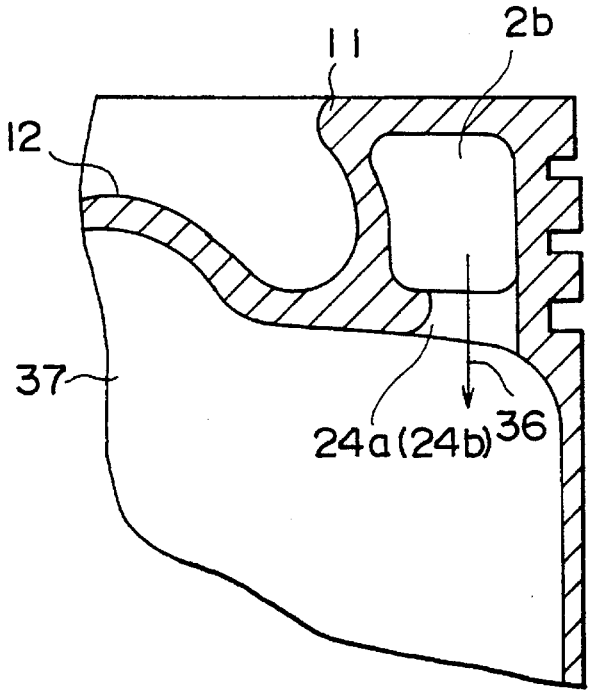
FIG. 5 is a cross-sectional view taken along line 5—5 in FIG. 2.

As shown in FIGS. 2 and 5, the two cooling liquid outlets 24*a*, 24*b*, which open downwardly from the bottom of the cooling cavity 2, are provided in the vicinity of the cooling cavity portion 2*b* having the largest annular width in the radial direction.

Figure 7:
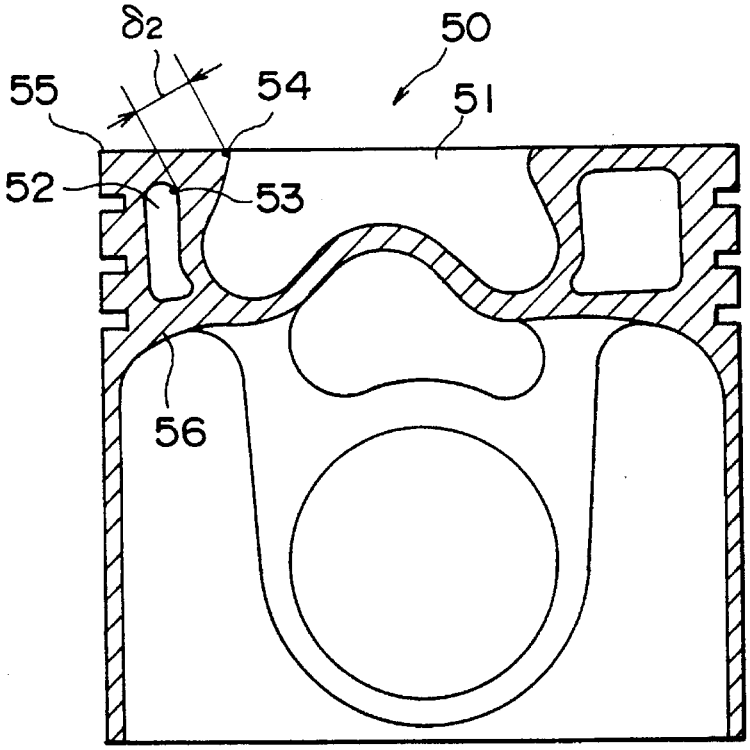
FIG. 7 PRIOR ART
FIG. 7 is a diagram illustrative of a conventional cooling structure of a diesel engine piston having a reentrant type combustion chamber.

The cooling cavity 2 will be explained by comparing it with the conventional cooling structure (see FIGS. 1 and 7). The conventional cooling cavity 52 has its largest radial width adjacent the lower transverse wall 56 and its smallest radial width adjacent the piston top face 55, with the bottom portion of the cooling cavity 52 projecting radially inwardly toward the longitudinal axis of the piston 50 beyond the inner extent of the top portion of the cooling cavity 52. In contrast, the cooling cavity 2 of the invention has its smallest radial width adjacent the lower transverse wall 4 and its largest radial width adjacent the piston top face 3, with the top portion of the cooling cavity 2 projecting radially inwardly toward the longitudinal axis of the piston 10 beyond the inner extent of the bottom portion of the cooling cavity 2. Thus, the configuration of the cooling cavity 2 in a plane containing the longitudinal axis of the piston 10 can be considered as substantially an upside-down version of the configuration of the cooling cavity 52 in a plane containing the longitudinal axis of the piston 50. The thickness of the wall located between the cooling cavity 2 or 52 and the corresponding combustion chamber 1 or 51, which is determined from the mechanical strength or the like of the material from which the piston is formed, must be at least as great as a predetermined value. Therefore, the thickness of this wall adjacent to the top of the cooling cavity 2 of the invention, as well as that at the vertical center of the cooling cavity 2 of the invention, can be substantially the same as that at the vertical center of the prior art cooling cavity 52 and substantially less than that at the top of the prior art cooling cavity 52. It is therefore apparent that the distance $\delta 1$ between the top 22 of the cooling cavity 2 and the reentrant section 11 in the piston 10 is substantially shorter than the distance $\delta 2$ between the top 53 of the cooling cavity 52 and the reentrant section 54 in the prior art piston 50.

The operation of the embodiment will now be described. When the piston 10 is at approximately the upper dead point during the operation of the direct injection diesel engine, there is a slight flow of air from the intake valve 42 to the exhaust valve 43 which is still open. The reentrant section portion 11*b*, which is between the intake valve 42 and the exhaust valve 43, is well cooled owing to the cooling effect produced by such air flow. On the other hand, the reentrant section portion 11*a*, which is the portion of the reentrant section 11 farthest from the intake valve 42 and the exhaust valve 43, tends to become very hot (see FIG. 6).

As shown in FIG. 3 and FIG. 4, a cooling liquid 32, which can serve also as the lubricating oil, is sprayed from the cooling nozzle 31, which is separately provided adjacent to the bottom of the piston 10, through the cooling liquid inlet passageway 23 toward the distributing member 26, which is formed in the top wall surface of the cooling cavity portion 2*c*. Although the injected cooling liquid 32 reaches the inlet of the cooling liquid inlet passageway 23 as a spreading spray, the annular wall 25 serves to efficiently funnel the spray of cooling liquid 32 into the cooling cavity section 2*c*. The cooling liquid 32 is then split into two streams of predetermined proportions by the smoothly curved apex at the lower end of the approximately triangular cross-sectional distributing member 26, with one stream passing through the cooling cavity 2 in a clockwise direction 34 from the cooling liquid inlet 23 to the cooling liquid outlet 24*a*, while the other stream passes through the cooling cavity 2 in a counterclockwise direction 35 from the cooling liquid inlet 23 to the cooling liquid outlet 24*b*.

The stream of cooling liquid 32 which goes in the clockwise direction 34 immediately flows through the cooling cavity portion 2*a* which has the smallest annular width in the radial direction, as shown in FIG. 2, i.e., in the vicinity of the reentrant section portion 11*a* which becomes hot most easily (see FIG. 6). Since at this point the cooling liquid 32 is substantially at its coldest temperature, it cools the reentrant section portion 11*a* very efficiently. This prevents the temperature of the reentrant section portion 11*a* from increasing excessively, thereby protecting the mechanical strength and the like of the material of the piston 10 from deterioration. Then the stream of cooling liquid 32, which is flowing in the clockwise direction 34, cools additional portions of the wall surface of the combustion chamber 1 and reaches the cooling liquid outlet 24*a*. The cooling liquid 32 which flows in the counterclockwise direction 35 also cools portions of the wall surface of the combustion chamber 1 and reaches the cooling liquid outlet 24*b*.

The resulting hot cooling liquid 32, which has reached the cooling liquid outlets 24*a* and 24*b*, flows out of the cooling cavity 2 in a downward direction 36, as shown in FIG. 5, and passes through the piston interior space 37. Then the cooling liquid is cooled and conditioned by a separately provided apparatus (not shown) before it is returned to the cooling liquid nozzle 31.

The above describes an embodiment of the present invention. The material used for the piston 10, however, is not limited to nodular graphite cast iron; it can alternatively be cast iron, aluminum alloy type material, or the like according to load or other operating conditions. Likewise, the shape of the cross-section of the distributing member 26 formed on the wall surface of the cooling cavity 2 is not limited to the approximately triangular shape; it can alternatively be a semicircle, rectangle, etc., as long as it serves to provide the required distributing function in each application.

Since, according to the present invention, the diameter of the inside wall surface of the cooling cavity 2, in a plane perpendicular to the longitudinal axis of the piston 10, is smaller adjacent the piston top face 3 than adjacent the lower transverse wall 4, the cooling liquid 32 is allowed to flow more closely to the reentrant section 11, thus providing higher cooling performance.

Moreover, since the radial width, and thus the cross-sectional area, of the cooling cavity 2 is larger adjacent the piston top face 3, more cooling liquid is allowed to flow in the vicinity of the reentrant section 11 and the increase in the temperature of the reentrant section 11 can be controlled. Thus, a high resistance to heat load can be achieved.

The funnel wall 25, provided as the inlet of the cooling liquid inlet passageway 23, makes it possible to efficiently introduce the cooling liquid 32, which is ejected from the cooling liquid nozzle 31, into the cooling cavity 2, thus reducing the amount of cooling liquid required and/or eliminating the need for a high-pressure injection of cooling liquid.

Moreover, the cooling liquid inlet passageway 23 is provided in the vicinity of the reentrant section portion 11*a*, which tends to become the hottest, i.e., the portion of the reentrant section where the radial distance between the combustion chamber 1 and the periphery of the piston 10 is the shortest. Therefore, the initially cold cooling liquid 32, which is capable of providing a better cooling effect, is allowed to promptly flow in the vicinity of the reentrant section portion 11*a* to ensure efficient cooling.

Further, the distributing member 26, provided in the cooling cavity 2 through which the cooling liquid 32 is supplied, makes it possible to distribute the cooling liquid 32 in predetermined proportions simply by adjusting the injecting direction of the cooling nozzle 31 with respect to the apex of the distributing member 26. This permits efficient cooling of the piston 10.

Thus, the cooling structure in accordance with the present invention is ideally suited for an engine which is required to exhibit high resistance to heat load.

What is claimed is:

1. A diesel engine piston comprising:

a piston body having a longitudinal axis, a top face, and a generally cylindrical outer periphery, with a reentrant combustion chamber formed in said top face;

an annular cooling cavity formed in said piston body circumferentially around and outwardly of an outer periphery of said reentrant combustion chamber, said annular cooling cavity having a top, a bottom, and an inner annular wall surface extending between the top and the bottom of said cooling cavity;

a cooling liquid inlet passageway formed in said piston body whereby cooling liquid can be supplied through said cooling liquid inlet passageway to said annular cooling cavity; and at least one cooling liquid outlet formed in said piston body whereby cooling liquid can be withdrawn from said annular cooling cavity through said at least one cooling liquid outlet;

wherein a top portion of said inner annular wall surface of said cooling cavity is located adjacent said top face and has a smaller diameter, in a plane perpendicular to said longitudinal axis, than a bottom portion of said inner annular wall surface.

2. A piston in accordance with claim 1, wherein the radial width of said cooling cavity along a radial line in a plane perpendicular to the longitudinal axis of said piston gradually increases from the bottom of said cooling cavity toward the top of said cooling cavity.

3. A piston in accordance with claim 1, wherein a cross-section of said cooling cavity in a plane containing said longitudinal axis is larger near the top of the cooling cavity than toward the bottom of the cooling cavity.

4. A piston in accordance with claim 1, wherein the radial thickness of the piston body between a vertical center of said inner annular wall surface of said cooling cavity and a radially adjacent annular wall surface of said reentrant combustion chamber is substantially equal to the radial thickness of the piston body between the top of said inner annular wall surface of said cooling cavity and a radially adjacent annular wall surface of said reentrant combustion chamber.

5. A piston in accordance with claim 1, wherein said cooling cavity has an outer annular wall surface, and wherein a difference between a diameter of the inner annular wall surface of said cooling cavity and a diameter of the outer annular wall surface of said cooling cavity, measured along a common line radial to said longitudinal axis, continuously varies about the circumference of said cooling cavity in a plane perpendicular to said longitudinal axis.

6. A piston in accordance with claim 5, wherein the radial width of said cooling cavity, viewed in a plane containing said longitudinal axis, varies from a minimum radial width adjacent the bottom of said cooling cavity to a maximum radial width adjacent the top of said cooling cavity.

7. A piston in accordance with claim 6, wherein said reentrant combustion chamber is formed in said top face decentered with respect to said longitudinal axis.

8. A piston in accordance with claim 1, wherein said cooling liquid inlet passageway has an inner annular surface which expands outwardly and downwardly from the bottom of the cooling cavity.

9. A piston in accordance with claim 1, wherein said piston body comprises a lower transverse wall, and wherein said cooling liquid inlet passageway has an inner annular surface which expands outwardly and downwardly from the bottom of the cooling cavity to form an outwardly and downwardly diverging annular funnel wall extending downwardly below said lower transverse wall and constituting an inlet of said cooling liquid inlet passageway.

10. A piston in accordance with claim 9, wherein a width of the cooling liquid inlet passageway within said funnel wall, viewed in a radial direction of the piston, becomes larger towards said inlet of said cooling liquid inlet passageway.

11. A piston in accordance with claim 10, wherein a distribution member is formed in said cooling cavity directly above said cooling liquid inlet passageway so as to divide a flow of cooling liquid from said cooling liquid inlet passageway into two streams for passage through said cooling cavity in opposite directions.

12. A diesel engine piston comprising:

a piston body having a longitudinal axis, a top face, and a generally cylindrical outer periphery, with a reentrant combustion chamber formed in said top face;

an annular cooling cavity formed in said piston body circumferentially around and outwardly of an outer periphery of said reentrant combustion chamber, said annular cooling cavity having a top, a bottom, and an inner annular wall surface extending between the top and the bottom of said cooling cavity;

a cooling liquid inlet passageway formed in said piston body whereby cooling liquid can be supplied through said cooling liquid inlet passageway to said annular cooling cavity; and at least one cooling liquid outlet formed in said piston body whereby cooling liquid can be withdrawn from said annular cooling cavity through said at least one cooling liquid outlet;

wherein a top portion of said inner annular wall surface of said cooling cavity is located adjacent said top face and has a smaller diameter, in a plane perpendicular to said longitudinal axis, than a bottom portion of said inner annular wall surface; and wherein a distribution member is formed in said cooling cavity directly above said cooling liquid inlet passageway so as to divide a flow of cooling liquid from said cooling liquid inlet passageway into two streams for passage through said cooling cavity in opposite directions.

13. A piston in accordance with claim 1, wherein said reentrant combustion chamber is formed in said top face decentered with respect to said longitudinal axis.

14. A piston in accordance with claim 13, wherein said cooling liquid inlet passageway is provided in said piston body in the vicinity of a portion of said annular cooling cavity where a radial distance between the reentrant combustion chamber and the generally cylindrical outer periphery of the piston is at a minimum.

15. A piston in accordance with claim 14, wherein said at least one cooling liquid outlet is provided in said piston body in the vicinity of a portion of said annular cooling cavity where a radial distance between the reentrant combustion chamber and the generally cylindrical outer periphery of the piston is at a maximum.

16. A piston in accordance with claim 15, wherein said cooling cavity has an outer annular wall surface, and wherein a difference between a diameter of the inner annular wall surface of said cooling cavity and a diameter of the outer annular wall surface of said cooling cavity, measured along a common line radial to said longitudinal axis, continuously varies about the circumference of said cooling cavity in a plane perpendicular to said longitudinal axis.

17. A piston in accordance with claim 16, wherein the radial width of said cooling cavity, viewed in a plane containing said longitudinal axis, varies from a minimum radial width adjacent the bottom of said cooling cavity to a maximum radial width adjacent the top of said cooling cavity.

18. A piston in accordance with claim 17, wherein the radial thickness of the piston body between a vertical center of said inner annular wall surface of said cooling cavity and a radially adjacent wall surface of said reentrant combustion chamber is substantially equal to the radial thickness of the piston body between the top of said inner annular wall surface of said cooling cavity and a radially adjacent wall surface of said reentrant combustion chamber.

19. A piston in accordance with claim 18, wherein said piston body comprises a lower transverse wall, and wherein said cooling liquid inlet passageway has an inner annular surface which expands outwardly and downwardly from the bottom of the cooling cavity to form an outwardly and downwardly diverging annular funnel wall extending downwardly below said lower transverse wall and constituting an inlet of said cooling liquid inlet passageway, with a width of the cooling liquid inlet passageway within said funnel wall, viewed in a radial direction of the piston, becoming larger towards said inlet of said cooling liquid inlet passageway.

20. A piston in accordance with claim 19, wherein a distribution member is formed in said cooling cavity directly above said cooling liquid inlet passageway so as to divide a flow of cooling liquid from said cooling liquid inlet passageway into two streams for passage through said cooling cavity in opposite directions.

* * * * *